United States Patent [19]

Mellor et al.

[11] Patent Number: 4,891,542

[45] Date of Patent: Jan. 2, 1990

[54] DICHROIC COATED LAMP WITH GETTERED OUTER JACKET

[75] Inventors: Charles Mellor, Salem; Timothy Fohl, Carlisle, both of Mass.

[73] Assignee: GTE Products Corporation, Danvers, Mass.

[21] Appl. No.: 278,692

[22] Filed: Dec. 1, 1988

[51] Int. Cl.[4] ..... H01J 5/16; H01J 61/26; H01K 1/54

[52] U.S. Cl. ..... 313/112; 313/111; 313/558; 313/560

[58] Field of Search ..... 313/111, 112, 113, 553, 313/559, 560, 562, 558

[56] References Cited

U.S. PATENT DOCUMENTS 3,946,262 3/1976 Keefe et al. ..... 313/562
4,839,553 6/1989 Mellor ..... 313/112 X

*Primary Examiner*—Kenneth Wieder
*Attorney, Agent, or Firm*—Joseph S. Romanow

[57] ABSTRACT

A method of prolonging the life of thin film dichroic coated lamp components and of employing inexpensive components has been discovered. This method is the use of a hydrogen getter located in the outer jacket of the lamp, adjacent to the dichroic coating. The getter is preferably located and aligned so as to reach an optimum operating temperature.

12 Claims, 1 Drawing Sheet

DICHROIC COATED LAMP WITH GETTERED OUTER JACKET

FIELD OF THE INVENTION

The present invention is directed to a dichroic coated incandescent lamp having a gettered outer jacket. It has been discovered that lamps employing dichroic coatings comprising alternating layers of $TiO_2$ and $SiO_2$, particularly those are attacked by hydrogen under the high temperature operating conditions of such lamps. The use of a hydrogen getter, preferably situated in a lamp location affording optimum operating temperature, prevents the attack on the dichroic coating, improving lamp life.

BACKGROUND OF THE INVENTION

Dichroic coatings are formed by the sequential deposition in alternate layers of materials having high and low refractive indices, each layer being an odd or even multiple of quarter wave length thickness related to monochromatic light of specific wavelength. Thus applied, dichroic coatings reflect certain bands of incident light waves and transmit other bands.

Ideally, the transmission and reflection occurring via a dichroic coating is prefectly controlled by the number of layers used and by the materials used in each of the layers. See for example, U.S. Pat. No. 1,425,967, granted to Hoffman in 1922.

The use of dichroic coatings as "cold" (i.e., heat rejection) mirrors is thus well known. Lamps fabricated with a dichroic coated reflector transmitting substantial amounts of infrared radiation and reflecting substantial amounts of visible radiation have been commercially available for many years, at least since about 1960. Such lamps are widely used in projector applications and as theatrical, television, and movie stage lights.

In contrast to the widely used cold mirrors, lamps may be designed using dichroic coatings to reflect wavelengths other than the visible, e.g., infrared. One such lamp is described in U.S. Pat. No. 4,604,680 (the '680 patent), the disclosure of which is hereby incorporated herein by reference Getters are materials which entrap extraneous gases. These materials have found wide use in vacuum tubes and high pressure electric discharge devices See for example U.S. Pat. Nos. 3,737,710 and 3,519,864, the disclosures of which are hereby incorporated herein by reference.

SUMMARY OF THE INVENTION

The present invention is directed to a dichroic coated incandescent lamp having a gettered outer jacket. It has ben discovered that incandescent lamps employing dichroic coatings comprising alternating layers of $TiO_2$ and $SiO_2$ are attacked by hydrogen (i.e., chemically a reduction reaction) under the operating conditions of the lamps. The use of a hydrogen getter, preferably situated in a lamp location affording optimum operating temperature, prevents the attack on the dichroic coating, improving lamp life.

The preferred hydrogen getter comprises baruim peroxide, aluminum silicate, and copper. It is believed that this getter effectively removes hydrogen from the lamp gases and contributes oxygen to the environment in accordance with the following chemical reactions:

$$BaO_2 + H_2 \longrightarrow Ba(OH)_2$$

$$BaO_2 \longrightarrow BaO + \tfrac{1}{2}O_2$$

$$2Cu + \tfrac{1}{2}O_2 \longrightarrow Cu_2O$$

$$Cu_2O + H_2 \longrightarrow 2Cu + H_2O$$

$$BaO + H_2O \longrightarrow Ba(OH)_2$$

$$Cu_2O + H_2 + \tfrac{1}{2}O_2 \longrightarrow 2CuOH$$

The present invention thus represents a solution to the reduction of the mirror coating by preventing the chemical activity of hydrogen by the use of a selective getter, which impedes the effect of hydrogen as a reducing agent to the coating, while at the same time providing a source of oxygen which maintains the stoichiometry of the coating materials at lamp operating temperatures (which typically exceed 400° C.).

The present invention is also directed to a method of prolonging the life of thin film dichroic coated lamp components which comprises adding a hydrogen getter to the outer jacket of such a lamp, proximate to the dichroic coatings.

DETAILED DESCRIPTION OF THE INVENTION

Figure 1:
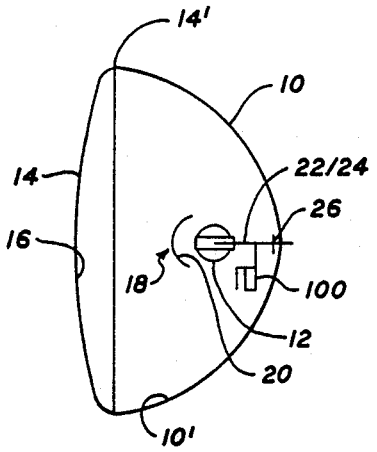
FIG. 1 illustrates the preferred placement for the getter of the present invention in the outer jacket of a PAR 56 NITE KAT lamp, sold by GTE Sylvania.

As set forth above, the present invention is directed to a dichroic coated incandescent or HID lamp having a gettered-outer jacket. Most preferably, the lamp improved by the present invention is GTE Sylvania's NITE KAT lamp, which is described in detail in the '680 patent cited above. However, it is anticipated that other dichroic coated lamps such as Long Life Brite Beam lamps in hot fixtures and HID NITE KAT lamps will likewise be improved by the addition of a hydrogen getter in accordance with the teachings of the present invention Refering in detail to the drawings, FIG. 1 is a schematic representation of a lamp described in the '680 patent, illustrating the preferred site for mounting the getter of the present invention 100 in the outer jacket thereof. This lamp contains a dichroic coated reflector 10 and 10' which is designed to effect filtering of the quartz-jacketed tungsten-halogen source 12 to preferentially reflect infrared light and preferentially transmit visible light. An hermetically sealed lens 14 (seal line=14') is dichroically coated on its interior 16 to reflect visible light and transmit infra-red light. An additional "shield" mirror 18 is located in front of the light source. Mirror 18 is dichroically coated 20 to reflect visible light and transmit infrared light. The mounting frame and electric leads (22 and 24), and the ferrule shield 26, complete the lamp structure.

Thus constructed, the lamp can be used as an infrared floodlight with numerous applications, e.g., surveillence work wherein the infrared light aids night vision.

For optimum performance, the NITE KAT lamp is advantageously operated in the fixture disclosed in U.S. Pat. No. 4,965,930, the disclosure of which is hereby incorporated herein by reference. The preferred NITE KAT fixture contains an absorption filter so that residual visible light not attenuated by the coatings is absorbed. This absorption filter is typically a red colored glass such as that known as RG-780 in the trade.

Filter glasses such as RG-780 absorb visible light, which results in a temperature rise to the glass. As a result, the filter glasses are thermally strengthened, but in the NITE KAT lamp this temperature rise can be sufficient to cause the filter glass to fracture, thus causing a failure of the lamp fixture. It has been discovered that by the insertion of a third dichroic coated mirror into the NITE KAT lamp, this temperature rise and subsequent fracture is minimized, thus allowing for safe and lengthy operation of the lamp.

This third mirror is shown in FIG. 1 as the "shield mirror." Preferably, the shield mirror is a hemi-cylindrical quartz substrate dichroically coated to withstand normal operating temperatures of the NITE KAT, i.e., up to approximately 740° C. The coating on this mirror is known in the trade as a cold mirror coating, i.e., it preferentially transmits infrared light and reflects visible light.

Cold mirror coatings are typically composed of a multilayer structure of dichroic refractory materials, such as $SiO_2/TiO_2$, $SiO_2/Ta_2O_5$, or $SiO_2/ZrO_2$. However, as the skilled artisan will readily recognize, other thin film coatings that are composed of refractory materials may be used as a cold mirror in this application.

Of the high temperature dichroic coating materials recited above that have been used for coating the NITE KAT shield mirror, the system using $TiO_2/SiO_2$ is the least expensive and is the most optically efficient, because in theory, it employs the fewest number of layers to achieve the desired optical performance.

However, the $TiO_2/SiO_2$ coating system is not without its drawbacks. As described above, this coating is subject to degradation by hydrogen in the lamp environment, which adversely affects the ultimate preformance of the NITE KAT lamp.

As set forth above, while the dichroic coating system using alternating layers of $TiO_2/SiO_2$ is the least expensive and is the most optically efficient, the $TiO_2/SiO_2$ coating system has been found to be subject to a reducing chemical reaction when used in incandescent infrared lamps such as the NITE KAT.

These reducing reactions have been found to be caused by the action of hydrogen, which when interacting with the coatings at temperatures of approximately 400° C. or higher, leads to the formation of non-stoichiometric titania compounds, such as $Ti_3O_5$ or other oxides denoted as $TiO_{2-x}$.

Similarly, these reactions can lead to the formation of titanium nitrides, which like the titania compounds, have absorptive visual properties, which cause the coatings to become opaque to the desired infrared light and nonreflective to the visible portion of the spectrum.

In addition, the chemically reactive changes in the coating disturbs the layered thin film structure, thus further deteriorating mirror performance. This causes the light output of the lamp to drop and may cause failure of the source due to overheating.

While not wishing to be bound by conjecture, the source of the hydrogen in the NITE KAT lamp is believed to be the quartz halogen source, which contains hydrides of bromine and phosphorus, residual combustion gases from the hermetic sealing fires, or from other contaminants. The amount of hydrogen present has been found to be less than about 1% (vol.) and greater than about 0.03% in average lamps of this type. A relatively constant level of hydrogen has been found in the outer jacket of production run NITE KAT lamps.

The intended fill of the outer jacket is 25% (vol.) nitrogen and 75% (vol.) argon, with other gases or impurities such as water vapor, carbon dioxide or oxygen kept below about 20 parts per million.

The present invention represents a solution to the reduction of the mirror coating by preventing the chemical activity of hydrogen by the use of a selective getter, which impedes the effect of hydrogen as a reducing agent to the coating, while at the same time providing a source of oxygen which maintains the stoichiometry of the coating materials at temperatures exceeding 400° C.

Figure 2:
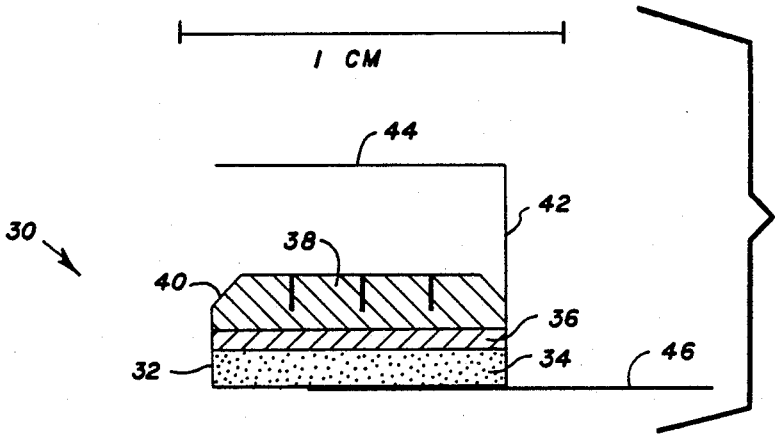
FIG. 2 illustrates a schematic diagram of the preferred getter of the present invention.

FIG. 2 illustrates the preferred hydrogen getter of the present invention. As depicted, the getter 30 comprises a nickel cup 32 containing barium peroxide powder 34. The $BaO_2$ is covered by a pad of aluminum silicate 36 and copper wool 38. The top edge of the nickel cup is crimped 40 to hold this assembly in one piece. A nickel wire 42 is welded to the side of cup 32 to serve as a support for a thin disc of nickel 44 mounted approximately 0.25 to 0.5 cm above the front of the getter. Disk 44 serves as a shield for the getter. The getter assembly 30 is mounted on a nickel wire 46 for attachment in the lamp outer envelope as illustrated in FIG. 1 at 100.

As described above, the copper is shielded from the direct rays of the light source, thus allowing for cooler operation of the getter. The use of a nickel shield also improves the shielding of the peroxide powder from ultra-violet rays generated by the source.

The preferred getter is constructed according to the method of U.S. Pat. No. 3,373,710, which is hereby incorporated herein by reference, but with the described modifications that make it especially useful for incandescent lamp applications. In general, the incandescent lamp outer jacket will be hotter that a high pressure electric discharge lamp outer jacket, so shielding and placement of the getter are more critical in the present application that in the latter devices.

The size and shape of the getter shield disc and the exact height of the disc can be varied to suit the exact dimensions of the getter, mounting and lamp type. In the preferred NITE KAT application, the disc should be approximately 0.1 mm or less in thickness to minimize the heating capacity due to the metal and maximize the cooling effect. The disc may have small holes drilled through it to effect free passage of gases, so long as greater than about 75% of the area of the getter is covered. The getter is mounted by means of another stiff nickel wire welded to the bottom of the cup and to a frame member.

The getter is preferably placed inside the NITE KAT lamp outer jacket in accord with the location shown in FIG. 1.

The present invention will be further illustrated with reference to the following example which will aid in the understanding of the present invention, but which is not to be construed as a limitation thereof. All percentages reported herein, unless otherwise specified, are percent by weight. All temperatures are expressed in degrees Celsius.

EXAMPLE

Construction of the NITE KAT getter of FIG. 2 required the placement of approximately 0.3 g to 0.7 g of barium peroxide powder into a nickel cup which is approximately 1 cm in diameter. This was covered by a thin pad of aluminum silicate, approximately 0.5 mm to 2 mm thick, and approximately 0.25 g of pure copper wool, or pure spun copper. The copper, aluminum silicate and barium peroxide are all commercially available.

The top edge of the nickel cup was crimped to hold this assembly in one piece. A nickel wire approximately 0.5 cm long was welded to the side of the cup to serve as a support for a thin disc of nickel that was mounted approximately 0.25 to 0.5 cm above the front of the getter.

The getter assembly was mounted in the outer envelope of a PAR 56 NITE KAT lamp approximately 5 mm to 20 mm behind the source, and about 5 mm to 20 mm above the ferrule shield, by attachment of the nickel support wire to the source mounting frame.

Operation of NITE KAT PAR 56 lamps with the getter of the present invention (substantially as depicted in FIG. 1) exhibited no evidence of coating deterioration during the rated lives of the lamps (lamp examples having rated lives of 2000 and 4000 hours were tested); in comparable ungettered NITE KAT lamps, coating deterioration was detected as early as 100 hours of operation.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A lamp comprising in combination:

(a) an hermetically sealed reflector and lens, said sealed reflector and lens defining an envelope having an interior surface and exterior surface, the interior surface of at least one of said lens and said reflector, bearing a dichroic coating;

(b) at least one inert gas disposed within the interior of said envelope;

(c) electrically energizeable source means for providing a source of light disposed within the interior of said envelope; and (d) means for gettering hydrogen disposed within the interior of said envelope, said gettering means comprising barium peroxide and copper.

2. The lamp of claim 1 which further comprises a shield mirror disposed in front of said source of incandescent light.

3. The lamp of claim 2, wherein the lens, reflector, and shield mirror each bear a dichroic coating.

4. The lamp of claim 3, wherein the lens dichroic coating reflects visible light and transmits infrared light.

5. The lamp of claim 3 or 4, wherein the reflector dichroic coating reflects infrared light and transmits visible light.

6. The lamp of claim 3 or 4, wherein the shield mirror dichroic coating reflects visible light and transmits infrared light.

7. The lamp of claim 1, wherein a significant portion of said gettering means is disposed in a location in said lamp wherein it is subjected to operating temperatures of up to about 400° C.

8. The lamp of claim 7, wherein said gettering means is disposed in a location proximate to said dichroic coating disposed on said lens, said reflector, or both.

9. The lamp of claim 7, wherein said gettering means is further provided with a metal shield protecting at least about 75 percent of the area of the getter.

10. The lamp of claim 9, wherein said metal shield for said gettering means is a nickel member with one or more holes therein.

11. A shielded getter member, selective for gettering hydrogen in a dichroic coated lamp, said getter member comprising a suitably sized nickel cup containing barium peroxide, aluminum silicate and copper wool, wherein the shield protects at least about 75 percent of the area of said getter member and comprises a nickel disk, 0.1 mm or less in thickness, mounted from about $\frac{1}{4}$ to $\frac{1}{2}$ cm above said getter member.

12. The shielded getter member of claim 11, wherein the shield contains one or more holes there through.

* * * * *